US009469927B2

(12) United States Patent
Hengesbach et al.

(10) Patent No.: US 9,469,927 B2
(45) Date of Patent: Oct. 18, 2016

(54) LAUNDRY TREATING APPLIANCE AND METHOD OF OPERATING A LAUNDRY TREATING APPLIANCE

(71) Applicant: Whirlpool Corporation, Benton Harbor, MI (US)

(72) Inventors: Brandon R. Hengesbach, Saint Joseph, MI (US); Tremitchell Wright, Elkhart, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 271 days.

(21) Appl. No.: 14/044,146

(22) Filed: Oct. 2, 2013

(65) Prior Publication Data

US 2015/0089979 A1 Apr. 2, 2015

(51) Int. Cl.

| | |
|---|---|
| ***D06F 21/02*** | (2006.01) |
| ***D06F 33/02*** | (2006.01) |
| *D06F 39/02* | (2006.01) |
| *D06F 35/00* | (2006.01) |

(52) U.S. Cl.

CPC ..... *D06F 21/02* (2013.01); *D06F 33/02* (2013.01); *D06F 35/006* (2013.01); *D06F 39/02* (2013.01); *D06F 2204/02* (2013.01); *D06F 2204/06* (2013.01); *D06F 2204/086* (2013.01)

(58) Field of Classification Search

None

See application file for complete search history.

(56) References Cited

U.S. PATENT DOCUMENTS

| | | | | |
|---|---|---|---|---|
| 5,823,018 | A | 10/1998 | Lee | |
| 7,761,187 | B2 | 7/2010 | Ko et al. | |
| 2004/0148970 | A1* | 8/2004 | Nakagawa | D06F 5/003 68/12.02 |
| 2009/0172893 | A1* | 7/2009 | Park | D06F 3/02 8/159 |
| 2010/0024137 | A1 | 2/2010 | Im et al. | |
| 2011/0061172 | A1* | 3/2011 | Koo | D06F 7/203 8/137 |
| 2011/0099731 | A1* | 5/2011 | Im | D06F 3/02 8/137 |
| 2011/0100070 | A1* | 5/2011 | Kim | D06F 5/006 68/200 |
| 2011/0154580 | A1* | 6/2011 | Kim | D06F 1/00 8/137 |
| 2012/0324654 | A1* | 12/2012 | Koo | D06F 7/304 8/137 |

FOREIGN PATENT DOCUMENTS

| | | | | |
|---|---|---|---|---|
| EP | 2050858 | A1 * | 4/2009 | D06F 39/02 |
| KR | 20100110509 | * | 10/2010 | D06F 39/00 |

* cited by examiner

*Primary Examiner* — Michael Barr
*Assistant Examiner* — Cristi Tate-Sims

(57) ABSTRACT

A laundry treating appliance having a tub having an open face and at least partially defining a treating chamber in which laundry may be received for treatment according to an automatic cycle of operation, a door for closing the open face of the tub, a perforated rotatable drum located within the tub and a method of operating such that the rotation of the drum is accelerated at a rate sufficient to cause an inrush of supplied liquid into the treating chamber from the tub via the perforations that locates a unit dose treating chemistry within the treating chamber.

17 Claims, 5 Drawing Sheets

LAUNDRY TREATING APPLIANCE AND METHOD OF OPERATING A LAUNDRY TREATING APPLIANCE

BACKGROUND

Laundry treating appliances, such as clothes washers, refreshers, and non-aqueous systems, may have a configuration based on a rotating drum that defines a treating chamber in which laundry items are placed for treating according to one or more cycles of operation. The laundry treating appliance may have a controller that implements the cycles of operation having one or more operating parameters. The controller may control a motor to rotate the drum according to one of the cycles of operation. Laundry treating appliances typically use one or more wash aids, such as detergent, fabric softener, bleach, and oxidizers, to treat a load of laundry. The wash aid may be supplied by a user directly into a treating chamber of the laundry appliance or into a wash aid dispenser.

BRIEF SUMMARY

In one aspect, an embodiment of the invention relates to a method of positioning a unit dose treating chemistry within a treating chamber of a laundry treating appliance including supplying an amount of liquid to the tub such that the liquid is at least at a first level where rotation of the drum relative to the tub will force liquid through the perforations, accelerating the rotation of the drum at an acceleration rate sufficient to cause an inrush of the supplied liquid into the treating chamber from the tub via the perforations when the liquid is at least at the first level, wherein the inrush of liquid locates a unit dose treating chemistry within the treating chamber.

In another aspect, an embodiment of the invention relates to a laundry treating appliance having a tub having an open face and at least partially defining a treating chamber in which laundry may be received for treatment according to an automatic cycle of operation, a door for closing the open face of the tub, a bellows coupled to the open face of the tub and configured to seal against the door when the door closes the open face of the tub, a perforated rotatable drum located within the tub, a liquid supply system for introducing liquid into one of the drum and tub, a motor drivingly coupled with the drum for rotating the drum, and a controller operably coupled with the liquid supply system to introduce liquid into one of the drum and tub such that the liquid is at least at a first level where rotation of the drum relative to the tub will force liquid through the perforations and operably coupled to the motor to accelerate the rotation of the drum at an acceleration rate sufficient to cause an inrush of supplied liquid into the treating chamber from the tub via the perforations when the liquid is at least at the first level and where the inrush of liquid locates a unit dose treating chemistry within the treating chamber.

DESCRIPTION OF EMBODIMENTS OF THE INVENTION

Figure 1:
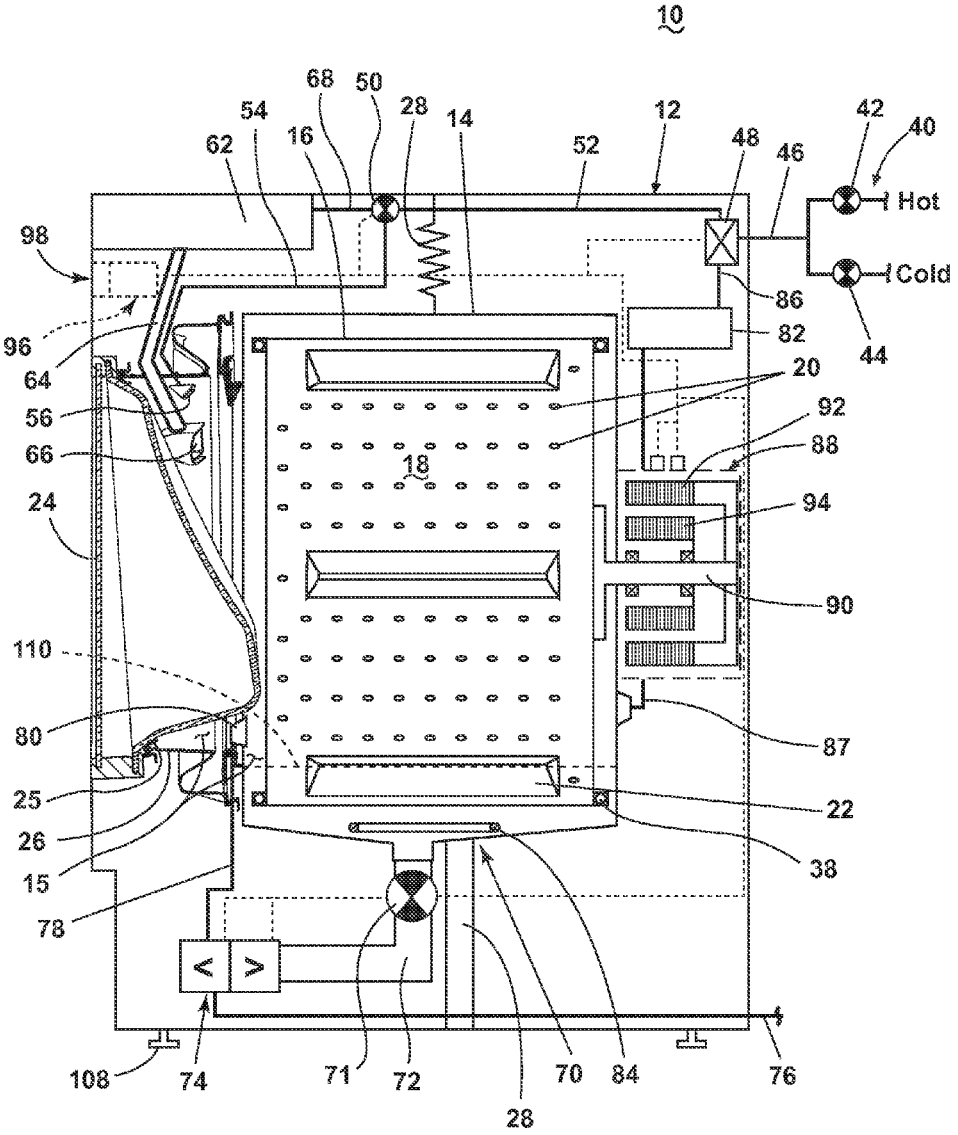
FIG. 1 is a schematic view of a laundry treating appliance in the form of a washing machine according to an embodiment of the invention.

FIG. 1 is a schematic view of a laundry treating appliance according to an embodiment of the invention. The laundry treating appliance may be any appliance which performs a cycle of operation to clean or otherwise treat items placed in a container therein, non-limiting examples of which include a horizontal or vertical axis clothes washer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12, which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a rotatable container or drum 16 provided within the tub 14. The tub 14 may at least partially define a liquid reservoir 15 and may at least partially define a laundry treating chamber 18 for receiving a laundry load for treatment. As the drum 16 is located within the tub 14 it may also be considered to define a portion of the treating chamber 18. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates.

The laundry holding system may further include a door 24, which may be movably mounted to the cabinet 12 to selectively close both the tub 14 and the drum 16. A bellows 26 may couple an open face of the tub 14 with the cabinet 12, with an outer surface 25 of the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. The liquid supply system may introduce liquid into the drum 16 and/or tub 14. For example, water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48, which may direct the flow of liquid to a supply conduit 52. The second diverter mechanism 50 on the supply conduit 52 may direct the flow of liquid to a tub outlet conduit 54, which may be provided with a spray nozzle 56, configured to spray the flow of liquid into the tub 14. In this manner, water from the household water supply 40 may be supplied directly to the tub 14. The spray nozzle 56 may alternatively be configured to direct the spray of liquid at the bellows 26. It will be understood that the spray nozzle may located in alternative locations to better spray portions of the bellows 26 including a lower portion of the bellows 26.

The washing machine 10 may also be provided with a dispensing system for dispensing treating chemistry to the treating chamber 18 for use in treating the laundry according to a cycle of operation. The dispensing system may include a dispenser 62, which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68. It will be understood that an alternative dispenser may be located in other portions of the washing machine 10 and that either the dispenser 62 or an alternative dispenser may be used for dispensing a unit dose treating chemistry into the drum 16.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through the tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. A drain valve 71 may be included in the sump conduit and may be moveable between an opened position and a closed position to control a flow of fluid into the sump conduit 72. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system, which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or the sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as is known in the art. Other motors, such as an induction motor or a permanent split capacitor (PSC) motor, may also be used. The motor 88 may rotationally drive the drum 16 including that the motor 88 may rotate the drum 16 at various speeds in either rotational direction. The motor 88 may be configured to rotatably drive the drum 16 in response to a motor control signal.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It is contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
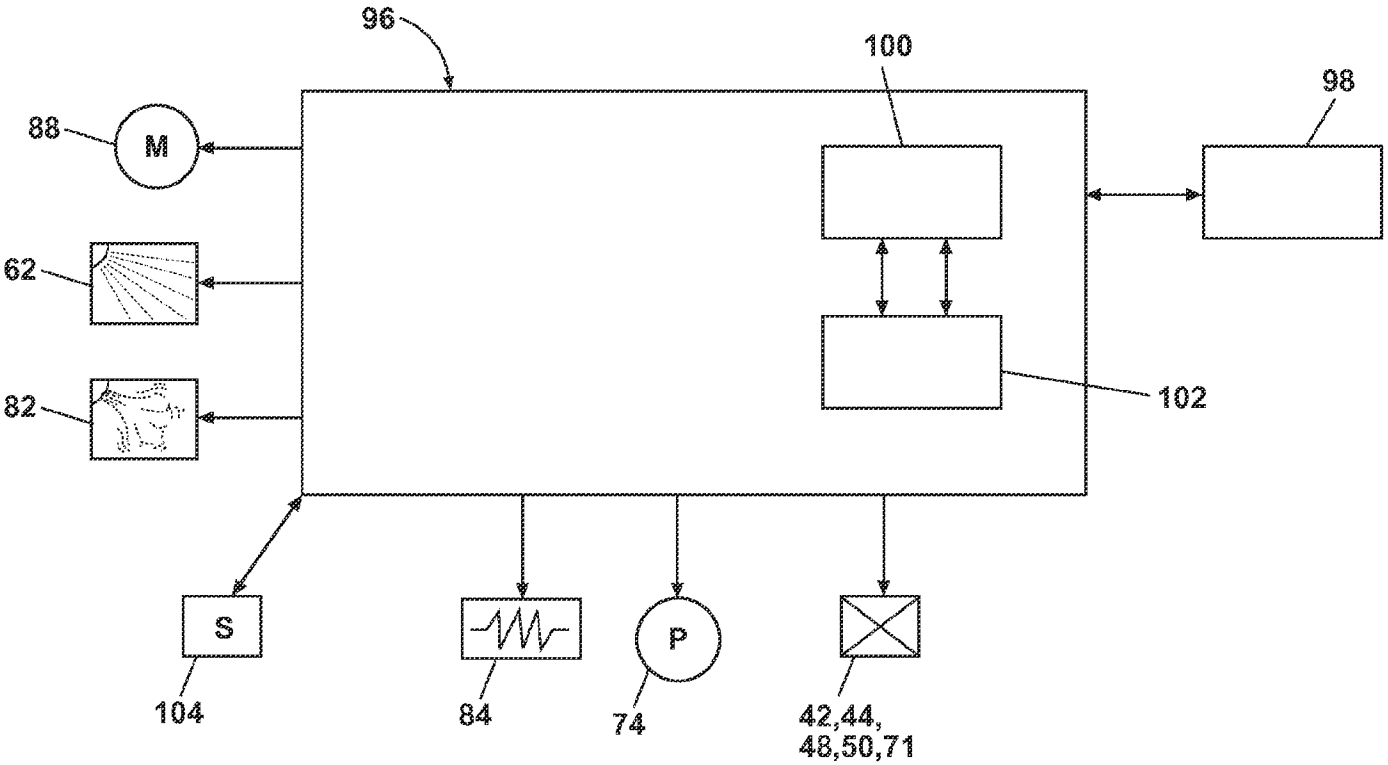
FIG. 2 is a schematic of a control system of the laundry treating appliance of FIG. 1.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82, the drain valve 71, and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an acceleration sensor, a speed sensor, an orientation sensor, an imbalance sensor, a load size sensor, and a motor torque sensor, which may be used to determine a variety of system and laundry characteristics, such as laundry load inertia or mass and system imbalance magnitude and position.

The operation of the washing machine 10 will now be described with a focus on locating a unit dose treating chemistry in the drum 16 and the treating chamber 18. The following description is provided for descriptive purposes only with the understanding that the operation may proceed in any suitable order and may be adapted according to variations of embodiments of the washing machine 10. To use the washing machine 10, a user typically opens the door 24 to load the laundry into the treating chamber 18 and supplies a desired treating chemistry, such as, for example, a detergent pod or unit dose treating chemistry, to the treating chamber 18 and then closes the door 24. It is alternatively contemplated that the unit dose treating chemistry may be supplied to the dispenser 62 by the user and the dispenser 62 dispenses the unit dose treating chemistry into the treating chamber 18.

Figure 3:
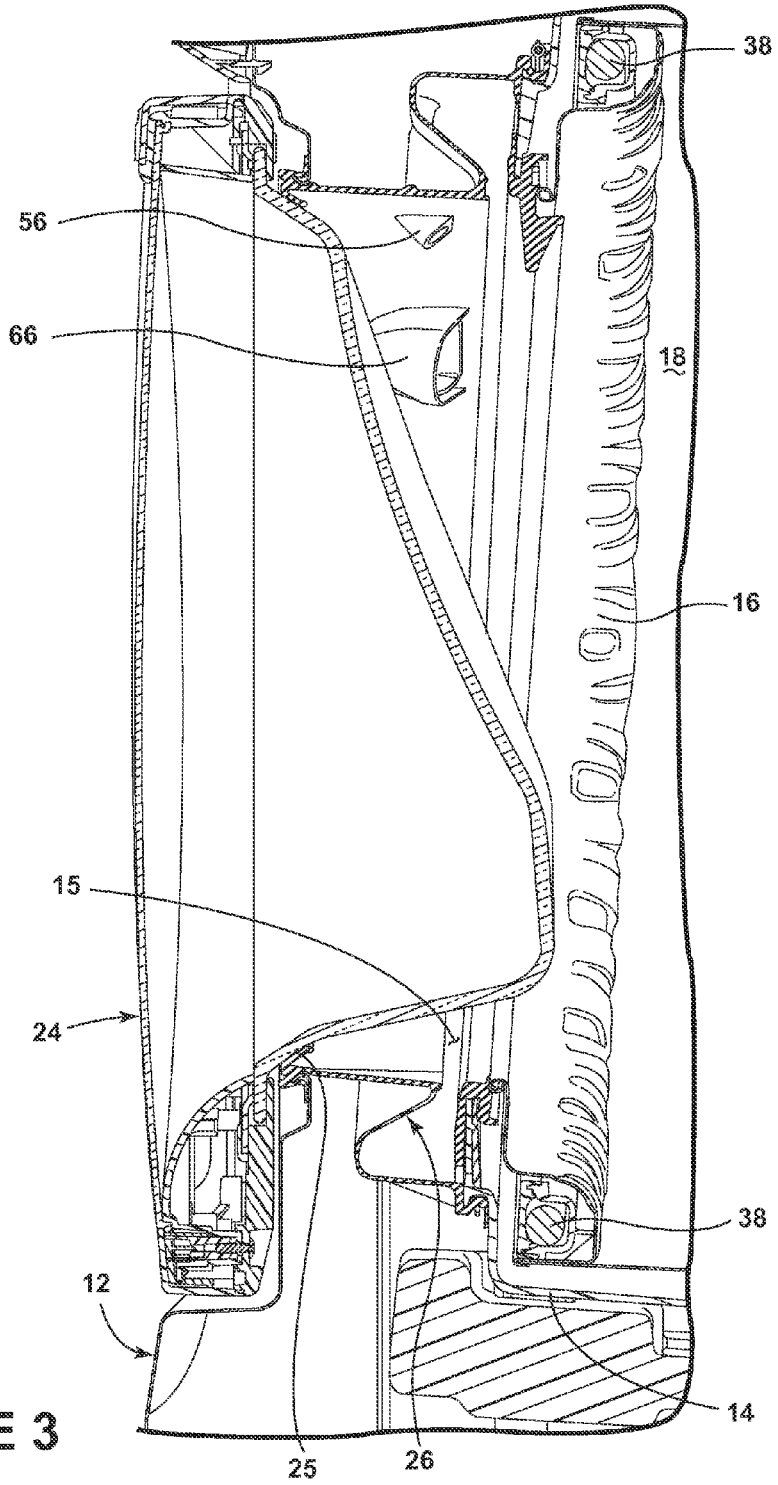
FIG. 3 is a close up view of portions of the laundry treating appliance of FIG. 1.

Regardless of where the unit dose treating chemistry is placed, when the door 24 is closed, the door 24 closes the open face of the tub 14, and a portion of the door 24 projects through the open face of the tub 14 such that it overlies an edge of the open face and also seals against the bellows 26, as shown in FIG. 3, by an outer surface 25 abutting the bellows 26 around the entire circumference of the door 24. The seal between the outer surface 25 and the bellows 26 inhibits the laundry from migrating through the open face of the treating chamber 18, thereby retaining the laundry load in the treating chamber 18. The shape of the door 24 may aid in preventing the laundry and possibly the treating chemistry from entering the gap and folds of the bellows 26. It also forms a fluid seal to prevent leakage of treating fluid out of the washing machine 10 between the door 24 and the cabinet 12.

After receiving from the user instructions to the controller 96 regarding a desired cycle of operation through the user interface 98, the controller 96 initiates the desired cycle of operation. At a beginning of the cycle of operation or when dispensing of the treating chemistry occurs during the cycle of operation, water may be supplied through the liquid supply system, such as through the inlet conduit 46 to the spray nozzle 56 or dispensing nozzle 66. The supply nozzle 56 may be located at an upper portion of the bellows 26 such that the water supplied to the treating chamber 18 flows along a liquid flow path from an upper portion of the door 24, where it is dispensed from the supply nozzle 56 down the bellows 26 and into the treating chamber 18.

Regardless of whether the user places the unit dose treating chemistry into the drum 16 or the dispenser 62 is used to dispense the unit dose treating chemistry into the treating chamber 18, it is contemplated that during the wash phase of a cycle, the unit dose treating chemistry may be improperly located into the liquid reservoir 15 or bellows 26. It will be understood that unit dose treating chemistries are available in many various geometry profiles with different densities and that a uniform geometry such as a spherical unit dose treating chemistry will react differently versus a non-uniform geometry such as a sheet unit doses treating chemistry once the unit dose treating chemistry is exposed to a laundry load. Further, the different unit dose treating chemistries may move differently depending on the laundry load type and such variables may dictate the path of the unit dose treating chemistry upon dispensing.

The controller 96 may control the liquid supply system to introduce liquid into one of the drum 16 and the tub 14 such that the liquid is at least at a first level 110 (FIG. 1) where rotation of the drum 16 relative to the tub 14 will force liquid into the treating chamber from the tub via the perforations. The controller 96 may also control the motor 88 to accelerate the rotation of the drum 16 at an acceleration rate sufficient to cause an inrush of supplied liquid through the perforations when the liquid is at least at the first level and where the inrush of liquid locates a unit dose treating chemistry within the treating chamber 18. For example, the controller 96 may accelerate the drum 16 so that the inrush of liquid flows over at least a portion of the bellows 26 so that a unit dose treating chemistry residing on the bellows 26 or trapped within the bellows 26 will be flushed into the treating chamber 18. By way of further example, the controller 96 may accelerate the drum 16 so that the inrush of liquid creates a cohesion force to maintain the unit dose treating chemistry within a laundry load in the treating chamber 18. The acceleration of the drum 16 may also change the movement of the laundry load within the drum 16, which may also aid in locating the unit dose treating chemistry within the treating chamber 18.

It is also contemplated that the controller 96 may move the drain valve 71 to a closed position while accelerating the rotational speed of the drum 16. This may increase water levels in the liquid reservoir 15 and bellows 26, resulting in a larger rush of water flowing over the bellows 26 and increasing the applied force to dislodge the unit dose treating chemistry. Further, the controller 96 may control a spray of liquid at the bellows 26, such as from the spray nozzle 56, when the rotation of the drum 16 is accelerated to further increase the liquid within the liquid reservoir 15 and/or bellows 26. Further, the controller 96 may reverse a rotational direction of the drum 16 to try and dislodge a unit dose treating chemistry from the bellows 26.

The bellows 26 may be formed from any suitable material including that the bellows may be formed from rubber. The bellows 26 may take any suitable shape including that the bellows 26 may have a geometry to aid in locating the unit dose treating chemistry in the drum 16. For example, the bellows may have a change in its lip so there is a divot-like geometry to allow the unit dose treating chemistry to be removed more easily by flushing. The geometry may be formed such that if the drum 16 is accelerated in reverse it will remove a trapped unit dose treating chemistry, but if in the forward direction the unit dose cannot enter the bellows 26.

Figure 4:
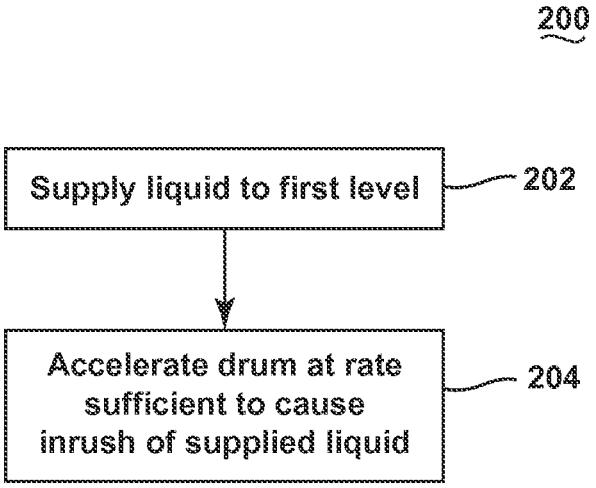
FIG. 4 is a flow chart illustrating a method of operating the laundry treating appliance according to an embodiment of the invention.

Referring now to FIG. 4, a flow chart of a method 200 for operating a laundry treating appliance, such as the washing machine 10, is illustrated. The sequence of steps depicted for this method is for illustrative purposes only, and is not meant to limit the method in any way as it is understood that the steps may proceed in a different logical order or additional or intervening steps may be included without detracting from the invention. The method 200 may be implemented in any suitable manner, such as automatically or manually, as a stand-alone phase or cycle of operation or as a phase of an operation cycle of the washing machine 10. The method 200 assumes that a user has provided laundry articles in the drum and a unit dose treating chemistry in the drum 16 or the dispenser 62. The method 200 also assumes that if the unit dose treating chemistry is provided in the dispenser 62 that it is dispensed either before the method 200 or during a first portion of the method 200.

Figure 5A:
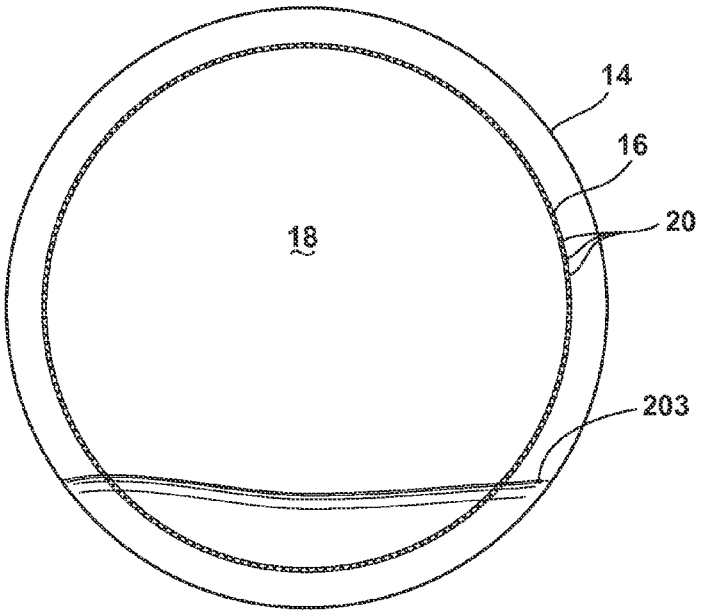
FIGS. 5A and 5B schematically illustrate liquid at a first level and rotation of the drum at an acceleration rate sufficient to cause an inrush of the supplied liquid.

At 202, the controller 96 may control the liquid supply system to supply an amount of liquid to the tub 14 such that the liquid is at least at a first level 203 (shown schematically at FIG. 5A) where rotation of the drum 16 relative to the tub 14 will force liquid through the perforations 20. For example, the controller 96 may introduce liquid through the spray nozzle 56 and/or dispensing nozzle 66. This may be done as part of an execution of the automatic cycle of operation including as part of a wash or pre-rinse portion of the cycle of operation.

Figure 5B:
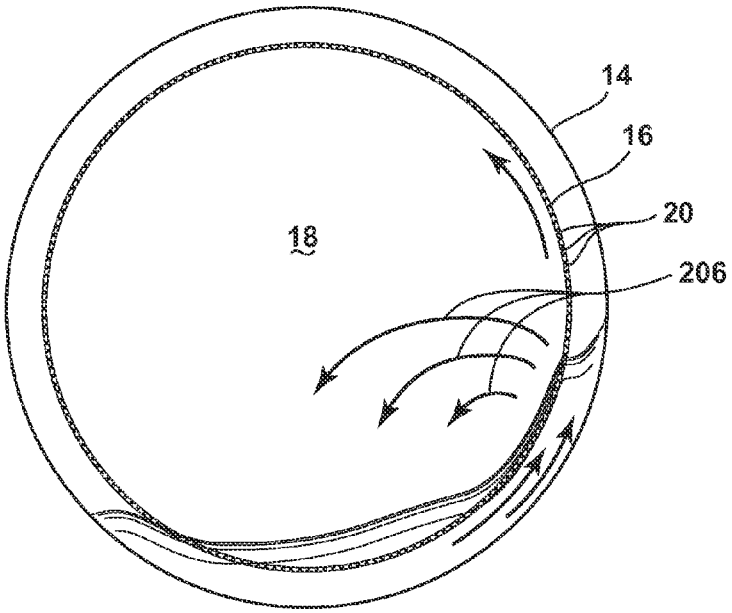

At 204, the controller 96 may rotate the drum 16 through operation of the motor 88 and may accelerate the rotation of the drum 16 at an acceleration rate sufficient to cause an inrush of the supplied liquid through the perforations 20 when the liquid is at least at the first level such that the inrush of liquid locates a unit dose treating chemistry within the treating chamber 18. The inrush of supplied liquid into the treating chamber 18 from the tub 14 via the perforations 20 is shown schematically as arrows 206 in FIG. 5B. Locating the unit dose treating chemistry in the treating chamber 18 may include that the inrush of the supplied liquid creates a cohesion force to maintain the unit dose treating chemistry within a laundry load in the treating chamber 18. The acceleration of the drum 16 introduces more water concentration to the laundry load increasing the density of laundry load mixture and making the densities between the laundry load and the unit dose more compatible. Additionally, increasing the density of the laundry load through water introduction increases the cohesion force of the laundry, essentially causing the unit dose to attach to it better. Further, locating the unit dose treating chemistry within the treating chamber 18 may include that the inrush of the supplied liquid forces the unit dose treating chemistry within the liquid reservoir 15 into the treating chamber 18. The accelerating may be sufficient to create an inrush of the supplied liquid such that it flows over at least a portion of the bellows 26 so that the unit dose treating chemistry residing on the bellows will be flushed into the treating chamber 18.

It is contemplated that at 204 the controller 96 may rotate the drum 16 through operation of the motor 88 to create bursts of acceleration, which may create an increased rush of liquid flow through the drum 16 and the bellows 26. Accelerating the rotation of the drum 16 may also be done as part of an execution of the automatic cycle of operation. Further, the accelerating the rotation of the drum is implemented during a wash phase of a cycle of operation. The drum 16 may be accelerated at any suitable rate including that the drum 16 may be accelerate above a tumbling speed of the laundry within the drum 16. This may include accelerating the drum above 30 RPM, accelerating the drum 16 between 50 RPM and 150 RPM, and/or accelerating the drum 16 between 90 RPM and 110 RPM. Accelerating the drum may include that the speed of the drum 16 may be ramped up and/or that the drum 16 may be rotated at a predetermined acceleration rate or within a range acceleration rates. For example, the speed of the drum 16 may be ramped such that the drum 16 may be rotated by the motor 88 from a non-satellizing speed to a satellizing speed. The accelerating the rotational speed of the drum 16 may occur for a predetermined amount of time to create the inrush of liquid.

It will be understood that the method may be flexible and that the method 200 illustrated is merely for illustrative purposes. For example, it is contemplated that the controller 96 prior to accelerating the rotation of the drum at an acceleration rate sufficient to cause an inrush of the supplied liquid may control the motor 88 to rotate the drum 16. For example, the controller 96 may cause the drum 16 to rotate at a tumbling speed or to be accelerated at a rate that does not cause an inrush of liquid. It is also contemplated that additional actions may be taken by the controller to locate the unit dose treating chemistry in the treating chamber. For example, the controller 96 may control the liquid spray system to create a spray of liquid into the drum 16 during the accelerating the rotational speed of the drum 16 to aid in forcing the unit dose treating chemistry into the treating chamber 18. The additional spray may assist in increasing a water flow through the bellows 26 to dislodge a trapped unit dose treating chemistry. Further, the controller 96 may control the operation of the motor 88 to cause a reversing of a rotational direction of the drum 16 including that the rotational speed of the drum 16 may be accelerate to create an inrush of liquid while the rotational direction is reversed. It is also contemplated that the after accelerating the rotation of the drum 16 the rotational speed of the drum 16 may be decelerated and/or rotated at a predetermined speed including that the drum 16 may be rotated at a tumbling speed.

The above described embodiments provided a variety of benefits including that the above described laundry treating appliance and method may be used to locate a unit dose in the treating chamber to aid in maintaining proper exposure of the unit dose treating chemistry to the liquid and laundry load. More specifically, the acceleration of the drum may dislodge a trapped unit dose treating chemistry from the bellows during a wash cycle, may return a unit dose to the treating chamber, and may improve the attraction of a properly placed unit dose within the drum to the laundry load. This may aid in improving cleaning performance and increasing customer satisfaction. Contemporary wash cycles do not include alternate speeds during a main wash, which results in uniform water and tumble flows. If a unit dose was introduced to the contemporary system, the system would not be able to dislodge a unit dose from the bellows due to consistent accelerations and spin speeds.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A method of positioning a unit dose treating chemistry within a treating chamber of a laundry treating appliance having a perforated rotatable drum located within a tub, with the tub at least partially defining a liquid reservoir and the tub at least partially defining a treating chamber in which laundry may be received for treatment according to an automatic cycle of operation, the method comprising:

during a wash phase of a cycle of operation, supply an amount of liquid to the tub such that the liquid is at least at a first level where rotation of the drum relative to the tub will force liquid through the perforations; and during the wash phase of a cycle of operation, accelerate the rotation of the drum at a first acceleration rate; and during the wash phase of the operation, further accelerating the rotation of the drum above the first acceleration rate to create bursts of acceleration above the first acceleration rate, wherein the bursts of acceleration above the first acceleration rate are sufficient to cause an inrush of the supplied liquid into the treating chamber from the tub via the perforations when the liquid is at least at the first level and wherein the inrush of the supplied liquid flows over at least a portion of a bellows extending from the tub toward a door so that a unit dose treating chemistry residing on the bellows or within the bellows will be flushed into the treating chamber.

2. The method of claim 1, further comprising controlling, by the controller, a spray of liquid into the drum while accelerating the rotation of the drum to aid in forcing the unit dose treating chemistry into the treating chamber.

3. The method of claim 1 wherein accelerating the rotation of the drum occurs for a predetermined amount of time.

4. The method of claim 1, further comprising decelerating the drum after accelerating the rotation of the drum.

5. The method of claim 1 wherein accelerating the drum comprises accelerating the drum above a tumbling speed.

6. The method of claim 5 wherein accelerating the drum above a tumbling speed comprises accelerating the drum above 30 RPM.

7. The method of claim 1 wherein locating the unit dose treating chemistry in the treating chamber comprises the inrush of the supplied liquid creating a cohesion force to maintain the unit dose treating chemistry with a laundry load in the treating chamber.

8. The method of claim 1, further comprising reversing a rotational direction of the drum.

9. The method of claim 1, further comprising rotating the drum at a tumbling speed after further accelerating the rotation of the drum.

10. The method of claim 1 wherein accelerating the rotation of the drum at an acceleration rate comprises accelerating up to a tumbling speed.

11. A method of operating a laundry treating appliance having a perforated rotatable drum located within a tub, with the tub at least partially defining a liquid reservoir and the tub at least partially defining a treating chamber in which laundry may be received for treatment according to an automatic cycle of operation and bellows coupled to an open face of the tub, the method comprising:

during a wash phase, moving a drain valve, located at a lower portion of the tub, to a closed position to obtain increased liquid levels in the tub;

during the wash phase, supplying an amount of liquid to the tub, when the drain valve is closed, such that the liquid reaches at least at a first level where rotation of the drum relative to the tub will force liquid through the perforations; and during the wash phase, rotating the drum at a first tumbling speed or accelerating the drum at a first rate; and during the wash phase, accelerating the drum up to a higher alternate speed or at a higher alternate rate, sufficient to cause an inrush of the supplied liquid into the treating chamber from the tub via the perforations when the liquid is at least at the first level and wherein the inrush of the supplied liquid flows over at least a portion of a bellows extending from the tub toward a door so that a unit dose treating chemistry residing on the bellows or within the bellows will be flushed into the treating chamber.

12. The method of claim 11, further comprising rotating the drum at a tumbling speed after the accelerating the drum up to the higher alternate speed or at the higher alternate rate.

13. The method of claim 11, providing a spray of liquid into the drum during the accelerating the drum up to the higher alternate speed or at the higher alternate rate.

14. The method of claim 11 wherein moving the drain valve to the closed position occurs during the accelerating of the drum up to the higher alternate speed or at the higher alternate rate.

15. A method of operating a laundry treating appliance having a perforated rotatable drum located within a tub, with the tub at least partially defining a liquid reservoir and the tub at least partially defining a treating chamber in which laundry may be received for treatment according to an automatic cycle of operation and bellows coupled to an open face of the tub, the method comprising:

during a wash phase, rotating the drum at a tumbling speed or accelerating the drum at an acceleration rate;

during the wash phase, supplying an amount of liquid to the tub such that the liquid reaches at least at a first level; and during the wash phase, accelerating the rotation of the drum at an alternative higher acceleration rate sufficient to cause an inrush of the supplied liquid into the treating chamber from the tub via the perforations when the liquid is at least at the first level and wherein the inrush of liquid flows over at least a portion of the bellows to flush a unit dose treating chemistry that is on the bellows or within the bellows into the treating chamber.

16. The method of claim 15, further comprising rotating the drum at a tumbling speed after accelerating the rotation of the drum at the alternative higher acceleration rate.

17. The method of claim 15, providing a spray of liquid into the drum during the accelerating the rotation of drum at the alternative higher acceleration rate.

* * * * *